US005861591A

United States Patent [19]

Wegener et al.

[11] Patent Number: 5,861,591

[45] Date of Patent: Jan. 19, 1999

[54] CIRCUIT BREAKER OPERATOR WHICH ACTUATES TOGGLE AND PUSH BUTTON SWITCHES AND HAS A MISALIGNMENT INDICATOR

[75] Inventors: John A. Wegener, Broken Arrow; Joe K. Hall, Owasso; Richard C. Emerson, Broken Arrow, all of Okla.

[73] Assignee: GSEG LLC, Farmington, Conn.

[21] Appl. No.: 904,218

[22] Filed: Jul. 31, 1997

[51] Int. Cl.[6] ..... H01H 1/20; H01H 3/20; H01H 3/08

[52] U.S. Cl. ..... 200/50.32; 200/330; 200/336

[58] Field of Search ..... 200/50.32, 50.33, 200/50.34, 50.36, 330, 331, 336, 308, 341; 335/161

[56] References Cited

U.S. PATENT DOCUMENTS 3,873,797 3/1975 Hannich ..... 200/308
4,282,500 8/1981 Ducroquet et al. ..... 335/18
5,180,050 1/1993 Rada et al. ..... 200/329
5,219,070 6/1993 Grunert et al. ..... 200/330
5,286,935 2/1994 Mina et al. .
5,577,603 11/1996 Bogdanovs et al. .

*Primary Examiner*—Ronald Stright, Jr.
*Assistant Examiner*—Michael J. Hayes
*Attorney, Agent, or Firm*—Howell & Haferkamp, L.C.

[57] ABSTRACT

A circuit operator with a push to test arrangement includes a housing. A first switch is mounted in the housing and has a toggle lever pivotably connected thereto so as to place the toggle switch in its on or off state. A second switch is also mounted in the housing and is connected to a push button for initiating tests. A single switch actuator allows a user to actuate the first switch and/or the second switch from an exterior of the housing.

20 Claims, 3 Drawing Sheets

CIRCUIT BREAKER OPERATOR WHICH ACTUATES TOGGLE AND PUSH BUTTON SWITCHES AND HAS A MISALIGNMENT INDICATOR

FIELD OF THE INVENTION

The present invention relates to circuit breaker operators and, more specifically, to circuit breaker operators having an integral push to test arrangement and a misalignment indicator.

BACKGROUND OF THE INVENTION

The use of switches in electrical circuits associated with machinery and other equipment are known in the art. Switches such as circuit breakers typically control the flow of electrical current and may take the form of a toggle switch with a lever that is manually operated between the ON and OFF positions to complete or interrupt the electrical circuit. Such switches are frequently placed in protective enclosures when used in explosive atmospheres (i.e., an environment containing flammable vapors) or otherwise harsh environments. Protective enclosures provide a measure of safety, i.e., by creating a barrier between flaming gases and the personnel operating the switches.

For switches housed in an enclosure, a remote operating device may be utilized to penetrate the enclosure walls and allow the switches to be externally operated. This is often the case for explosion-proof or hazardous location-related enclosures in which an externally operated switch may be required.

Prior art remote operators, however, are limited in their function. They are only capable of turning ON or OFF a single corresponding switch per remote operator. However, in practice, circuits may have coupled thereto a plurality of switches such as a circuit breaker, fault test initiators and so forth. Given the limitations of current remote operators, the additional switches associated with the circuits must either be operated by a person from an internal position in the enclosure (i.e., opening the panel and operating the switch), or a separate remote operator must be incorporated into the enclosure for those additional switches. For the former case, the internal operation of a switch is impractical and especially dangerous for explosion-proof or hazardous location-related enclosures, as described above. For the latter case, the incorporation of additional remote operators into the enclosure increases the overall cost of the system and, more importantly, decreases the overall integrity of the enclosure by requiring additional holes to be drilled into the enclosure.

Accordingly, there is a desire to provide a remote operator that is capable of functioning to operate a toggle switch in a circuit breaker or the like, and concomitantly therewith a push to test switch.

Other problems associated with prior art remote operators also involve the misalignment of the remote operator with respect to the toggle lever, when the panel of the enclosure is in the closed position. For example, during product assembly, installation and maintenance, the door must be opened and the remote operator disengaged with the circuit breaker in either the ON or OFF position. Reclosing the door with a misaligned operator prevents the operator from engaging the breaker toggle, leaving the circuit breaker inoperable. Moreover, the occurrence of a misalignment may not be apparent, particularly in light of the fact that the door is in the closed position thereby preventing a view of the operator and switch.

In addition, misalignment is typically remedied by painstakingly guiding the operator onto a toggle lever (for actuating a switch) as the door closes. This task is performed blindly, requiring the person making the adjustment to do so with the enclosure door closed (i.e., not seeing how the operator mates with the toggle lever).

One approach to remedy the above problem is to employ a remote, self-adjusting operator as disclosed in U.S. Pat. No. 5,286,935 to Mina et al. and U.S. Pat. No. 5,577,603 to Bogdanovs et al. Both remote operators automatically move into an aligned position with respect to the toggle lever, when the door to the enclosure is closed. Such devices do not provide or require an indication of a misalignment.

There is a desire to provide an alternative approach to the misalignment problem in which a circuit operator is capable of indicating a misalignment of the circuit operator with respect to the toggle lever, when the door of the enclosure is in the closed position. There is also a desire to provide a circuit operator that provides a safe and easy method for realigning the circuit operator with the toggle lever when the door of the enclosure is in the closed position.

In view of the foregoing, it is an object of the present invention to provide a circuit operator that is capable of externally operating multiple switches, i.e., a circuit breaker and fault test switch, maintained in a housing.

It is a further object of the invention to construct the above circuit operator such that fewer holes need to be drilled in the housing, thereby proving a stronger housing that requires less materials and reduces the assembly time of the overall device.

Another object of the invention is to provide a misalignment indicator which indicates a misalignment of a switch actuator, when a cover of the housing is in the closed position.

It is still yet a further object of the invention to provide a circuit operator that provides a simple, easy method for realigning the switch actuator, when an openable cover of the housing is in the closed position.

SUMMARY OF THE INVENTION

A circuit operator with a push to test arrangement includes a housing. A first switch is mounted in the housing and has a toggle lever pivotably connected thereto so as to place the toggle switch in its on or off state. A second switch is also mounted in the housing and is connected to a push button for initiating tests. A single switch actuator allows a user to actuate the first switch or the second switch from an exterior of the housing.

The switch actuator preferably includes a plate positioned in the housing and having a first surface and second surface opposite the first surface. The first surface has two feet, preferably in parallel, that extend therefrom to position on opposing sides of the toggle lever of the first switch. The plate further includes a surface portion adjacent to the feet and opposing the second switch. The switch actuator further includes a plate operating mechanism, preferably an external handle coupled to the plate across a shaft that passes through the housing. The plate operating mechanism can be operated externally (i.e., via the handle) to move the plate in a first and second direction (i.e., longitudinal direction) to toggle the toggle lever between the feet and/or in a third and fourth direction (i.e., axial direction), orthogonal to the first and second directions, to trigger the second switch.

As can be appreciated, the present invention allows a manufacturer to produce a housing with fewer holes therein and, thus, capable of having thinner walls. This results in a stronger housing for withstanding explosive pressure, particularly in an industry where minimizing the wall thickness of the housing is very important. The present invention further reduces the cost of the housing by reducing drilling time and assembly time.

The present invention also includes a misalignment feature which indicates a misalignment of the switch actuator, when an openable cover of the housing is in the closed position. A misalignment of the switch actuator occurs when either feet of the plate are in contact with an upper surface of the toggle lever and a cover member of the housing is in the closed position (a MISALIGNED position). This unexpected contiguity forces the plate, to move in the axial direction towards the housing which, in turn, forces the gear and shaft also to move in the axial direction towards the housing. As a result, the externally positioned handle moves away from the housing. The movement of the external handle as well as the distance between the handle and the exterior of the housing indicates the occurrence of a misalignment between the switch actuator and the toggle lever.

DETAILED DESCRIPTION OF THE PREFERRED EMBODIMENTS

Figure 1:
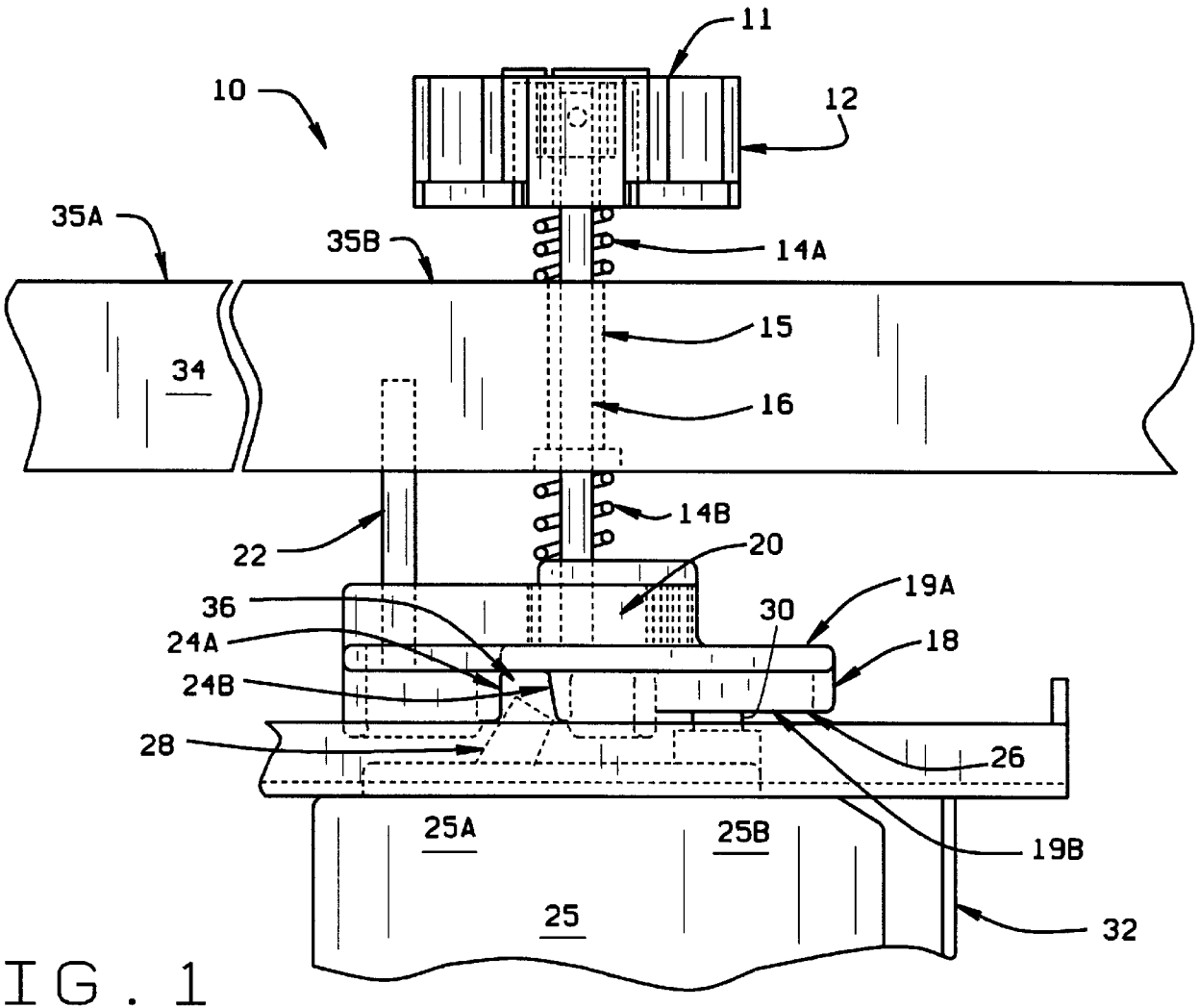
FIG. 1 is a cross-sectional view of a circuit breaker operator in accordance with the present invention.

Referring to FIG. 1, a circuit breaker operator 10 provides a housing having therein multiple switches 25A, 25B such as a circuit breaker and a switch which energizes a ground fault simulation circuit and a switch actuator 11 having an external handle 12 for providing external operation of the multiple switches. Handle 12 can be rotated in either direction to operate a first switch 25A, i.e. a circuit breaker, and moved towards and away from the housing to activate a second switch 25B, i.e., a ground fault simulation circuit.

In particular, circuit breaker operator 10 includes a housing 34 having mounted therein a panel board 32 having a plurality of switches 25 including at least a first switch 25A and/or a second switch 25B. Housing 34 comprises a body portion 35A and an openable cover member 35B for allowing access to an interior of housing 34. Cover member 35B includes an aperture 15 thereon for receiving a portion of a shaft therethrough. Body portion 35A and cover member 35B are made from a suitably strong material, such as cast aluminum, to withstand explosive pressures from within or hazardous environmental conditions. Body portion 35A and cover member 35B can be connected together by hinges or other suitable means.

Circuit breaker 25 has positioned thereon a toggle lever 28 for turning first switch 25A to an ON or OFF state. It is preferred that first switch 25A is a circuit breaker. Circuit breaker 25 further has positioned thereon a push button 30, adjacent to toggle lever 28, for operating second switch 25B which preferably initiates a fault test. It is preferred that second switch 25B is a switch for a test circuit such as a ground fault interrupt (GFI) simulator (not shown). The ground fault simulation circuit (not shown), when activated, causes first switch 25A to trip. Although FIG. 1 only describes two switches, panel board 32 may include a plurality of switches for operating various circuits contained therein. In fact, panel board 32 must not necessarily be present for this plurality of switches to be present and functional.

Circuit operator 10 further includes a switch actuator 11 for operating both toggle lever 28 and push button 30. Switch actuator 11 includes a handle 12 located on an exterior of cover member 35B, a plate 18 having a first surface 19A and a second surface 19B (FIG. 1 and 3) opposite first surface 19A, and a shaft 16 having a portion passing through aperture 15 and connected between handle 12 and first surface 19A of plate 18 by way of a gear 20. Shaft 16 is connected to first surface 19A of plate 18 by way of gear 20 such that rotational movement of handle 12 is translated into longitudinal movement of plate 18 and axial movement of handle 12, i.e. towards and away from housing 12, moves plate 18 towards and away from circuit breaker 25. Handle 12 can thus be rotated in either direction to move plate 18 in the longitudinal directions and moved in the axial directions (i.e., towards and away from housing 12) to move plate 18, likewise, in a corresponding axial direction.

Figure 3:
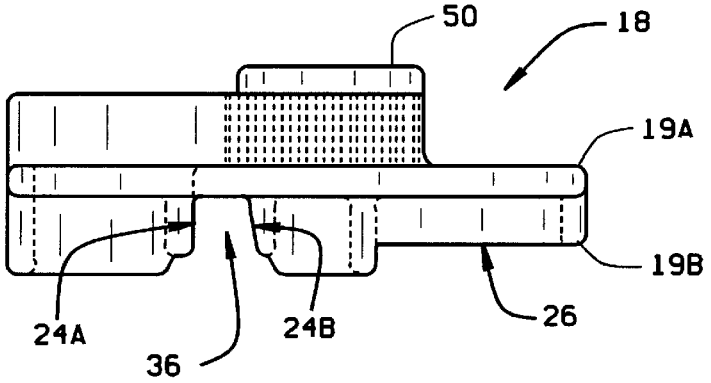
FIG. 3 is a side view of an actuator plate of FIG. 1.

As shown in FIGS. 1 and 3, second surface 19B of plate 18 has extending therefrom a first foot 24A and a second foot 24B, preferably substantially parallel to each other. There is provided between feet 24A, 24B a space 36 for receiving therein toggle lever 28, when cover member 35B is in the closed position. When the cover member is in the closed position and the toggle lever is positioned between feet 24A, 24B (hereinafter the NORMAL position of switch actuator 11), handle 12 can be rotated to cause plate 18 to move in a first or second longitudinal direction, thereby causing either foot 24A or 24B to contact toggle lever and toggle lever 28 to an ON or OFF state.

On second surface 19B of plate 18, there is also provided a contact surface 26, adjacent to foot 24B. When cover member 35B is in the closed position, contact surface 26 is positioned over push button 30. Handle 12 can be moved towards housing 34 to cause contact surface 26 to press against push button 30, thereby actuating second switch 25B. The actuation of second switch 25B activates a test circuit which simulates a ground fault and trips first switch 25A. Note that contact surface 26 can be positioned adjacent to either feet 24A, 24B depending on the location of push button 30.

Figure 2:
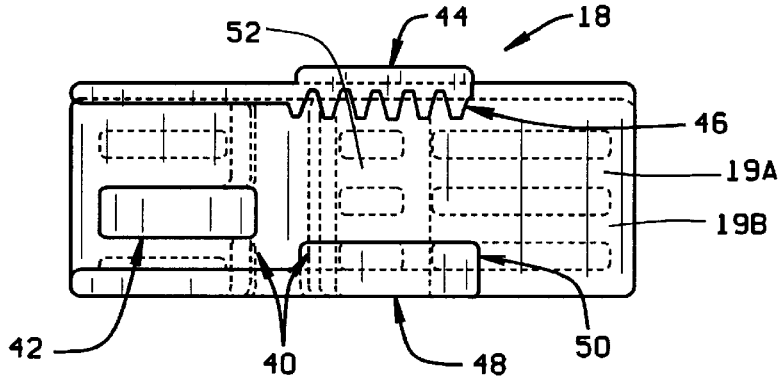
FIG. 2 is a plan view of an actuator plate of FIG. 1.
Figure 4:
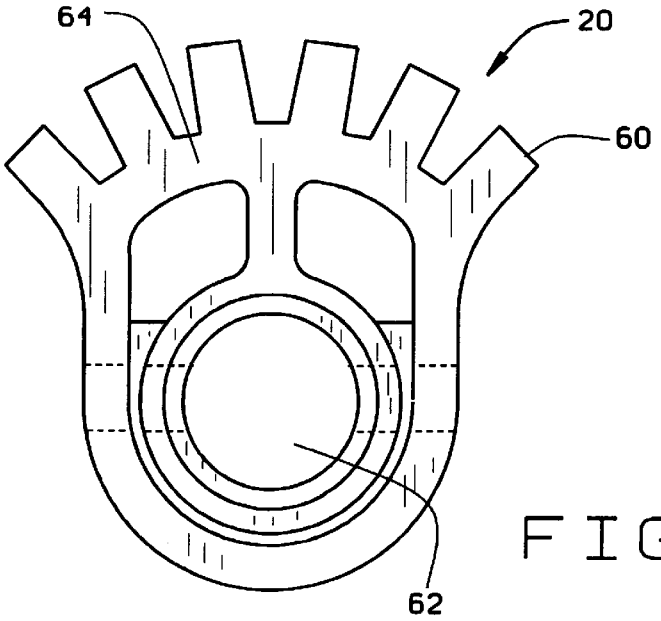
FIG. 4 illustrates a gear in accordance with the present invention.
Figure 5:
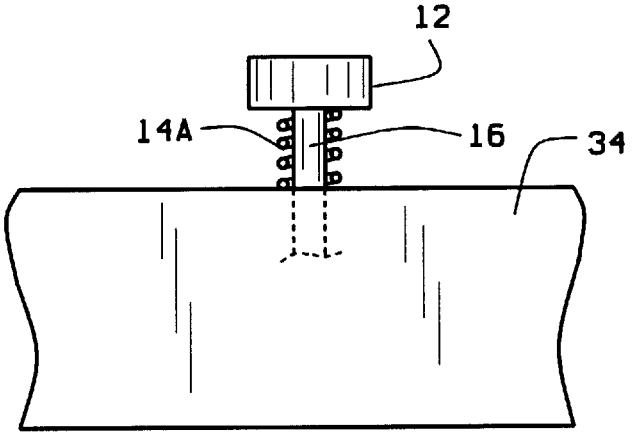
FIG. 5 illustrates a position of a handle and shaft of FIG. 1 in a NORMAL position.
Figure 6:
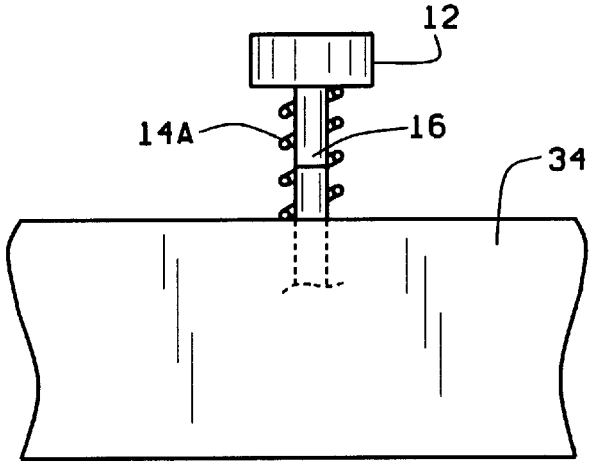
FIG. 6 illustrates a position of a handle and shaft of FIG. 1 in a MISALIGNED position.

Referring to FIG. 2, first surface 19A of plate 18 includes a gear rack 44 having a plurality of gear teeth 46 and an extending structure 48, opposite gear rack 44 and having a lip extending therefrom. A space 52 is provided between extending structure 48 and gear rack 44 for receiving gear 20 therein. As shown in FIG. 4, gear 20 includes a centrally positioned hole 62 for connecting to shaft 16 and a plurality of gear teeth 60 radially extending from a portion 64 of gear 20. When gear 20 is positioned in space 52 of plate 18, gear teeth 60 of gear 20 meshes with gear teeth 46 of gear rack 44 and lip 50 is positioned above gear 20, preferably over an edge of the gear, to movably secure the shaft assembly, i.e., the gear, shaft and handle, to plate 18. The above gear system converts rotational movement of shaft 16 and connected gear 20 to translational or linear movement of plate 18 in the longitudinal directions.

Plate 18 further includes a longitudinal slot 42 between first and second surfaces 19A, 19B, also shown in FIG. 2. Referring to FIGS. 1 and 2, a pin 22 connected to an interior surface of cover member 35B is positioned in slot 42 to keep plate 18 moving in the longitudinal and/or axial (to the shaft and pin) directions. It should be noted that pin 22 and plate 18 remain free from each other except for the limited travel allowed by longitudinal slot 42 in plate 18 and the travel afforded by a first spring 14A. By limiting travel along the longitudinal direction, the task of realigning switch actuator 11, in the case of misalignment, is made simple and easy. That is to say, the range of the longitudinal movement of plate 18 can be preset so as to require less experimentation or play to realign plate 18 with toggle lever 28.

Referring again to FIG. 1, circuit operator 10 also includes a first compression spring 14A positioned around shaft 16 and between handle 12 and cover member 35B of housing 34. First spring 14A allows switch actuator 11 to return to the NORMAL position after handle 12 is pushed in an axial direction towards housing 34 to operate second switch 25B (i.e., the push to test feature). First spring 14A similar to longitudinal slot 42 of plate 18 (FIG. 2) limits movement along the axial direction and, likewise, simplifies the task of realigning switch actuator 11. In the interior of housing 34 (FIG. 1), there is also provided a second compression spring 14B positioned around shaft 16 and between an interior surface of cover member 35B of housing 34 and gear 20. Second spring 14B allows switch actuator 11 (i.e., the shaft assembly including handle, shaft and plate) to return to the NORMAL position if actuator 11 is realigned with toggle lever 28 of first switch 25A.

Provided herein is an example of an operation of the multi-switching function of the present invention. Initially, when cover member 35B is in the closed position, handle 12 may be used to operate externally either toggle lever 28 (i.e., the circuit breaker) or push button 30 (i.e., GFI switch). The former can be performed, for instance, by turning or rotating handle 12 in such a manner as to cause gear 20, within housing 34 and attached to handle 12 across shaft 16, to turn and engage gear rack 44 of plate 18. The rotation of gear 20 in turn is translated by gear rack 44 into a corresponding longitudinal or linear movement of plate 18. Therefore, if toggle lever 28 is in the ON position and handle 12 is turned toward the OFF position, plate 18 would be translated in such a manner to cause feet 24A, 24B of plate 18 to push toggle lever 28 of first switch 25A (i.e., circuit breaker) toward the OFF position and vice-versa.

Although switch actuator 11 and plate 18 are arranged with respect to a front panel or cover 35B as described above and shown in FIG. 1, switch actuator 11 and plate 18 may also be arranged with respect to a side panel or cover of housing 34 to operate toggle lever 28 and push button 30. In this case, handle 12 can be rotated to operate push button 30 or pushed and pulled to operate toggle lever 28.

When a GFI breaker is in the ON position, pushing handle 12 causes shaft 16 to move in the axial direction (along the axis of shaft 16) further into housing 34, spring 14A to be compressed and surface 19B of plate 18 to be moved towards push button 30. Surface portion 26 of plate 18 contacts push button 30 of second switch 25B (i.e., GFI switch) and activates a test circuit that trips first switch 25A, the circuit breaker. As this occurs, toggle lever 28 moves from the ON position to the TRIPPED position. The movement of toggle lever 28 exerts a force in the linear direction on plate 18, thereby causing plate 18 to move in the linear direction (along an axis of plate 18). The movement of plate 18, in turn, causes gear 20 to turn, via gear rack 44, and then shaft 16 to turn. The turning shaft causes handle 12 to turn and to indicate a new position of switch 25A. In this way, the position of toggle lever 28, i.e., ON, TRIPPED or OFF state, is indicated by the external positioning of handle 12. Note that when handle 12 is released by the person operating switch actuator 11, compression spring 14A discharges and axially moves shaft 16 and components thereon (i.e., the components of switch actuator 11) towards the outside of housing 34, and to the NORMAL position.

Although switch 25A can be manually tripped by pushing handle 12 to activate a fault test, via push button 30, much of the operation described above would be the same if switch 25A tripped on its own accord.

Another feature of the present invention is the misalignment indicator, an example of which is provided below. Misalignment of plate 18 with toggle lever 28 may sometimes occur when cover member 35B of housing 12 is closed. In particular, this occurs where either foot 24A or 24B of plate 18 contacts an upper surface of toggle lever 28 (the MISALIGNED position), instead of being positioned on opposite sides of toggle lever 28 (the NORMAL position). This unexpected contiguity forces plate 18 to move in the axial direction towards housing 34 which, in turn, forces gear 20 and shaft 16 also to move in the axial direction towards housing 34. As a result, handle 12 moves away from housing 34 and compresses second spring 14B against the internal surface of housing 12. The movement of handle 12 as well as the distance between handle 12 and the exterior of housing 34 indicates the occurrence of a misalignment between switch actuator 11 and toggle lever 28.

In the event that switch actuator 11 is misaligned with toggle lever 28, switch actuator 11 can be simply and easily realigned by turning handle 12 in either directions. The longitudinal and axial movement of plate 18 are respectively limited by longitudinal slot 42 and pin 22, and first spring 14A. As previously discussed, the range of motion can be limited so that less experimentation is required to realign switch actuator 11 (particularly feet 24A, 24B of plate 18) with toggle lever 28. When switch actuator 11 is realigned with toggle lever 28, second spring 14B discharges and moves actuator 11 back to a normal position, i.e., handle 12 and shaft 16 moves back towards housing 34. As can be appreciated by those skilled in the art, actuator 11 can be simply and easily realigned without reopening cover member 35B or requiring cumbersome and time-consuming experimentation.

The invention having thus been described with particular reference to the preferred forms thereof, it will be obvious that various changes and modifications may be made therein without departing from the spirit and scope of the invention as defined in the appended claims.

We claim:

1. A circuit operator, comprising:

(a) a housing;

(b) a first switch mounted in said housing and having a toggle lever pivotably connected so as to place said toggle switch in its on or off state;

(c) a second switch mounted in said housing and having means for initiating tests; and (d) single means for both actuating said first switch and actuating said second switch from an exterior of said housing.

2. The circuit operator as recited in claim 1, wherein said single means is rotated to operate one of said first and second switches and pushed or pulled to operate the other of said first and second switches.

3. The circuit operator as recited in claim 1, wherein said single means includes:

a plate positioned in said housing and having a first surface and second surface opposite said first surface, said first surface having two feet extending therefrom to position on opposing sides of said toggle lever and a surface portion adjacent to said feet opposing said push button switch; and operating means for moving said plate in a first and second direction to toggle said toggle lever between said feet or in a third and fourth direction, orthogonal to said first and second directions, to trigger said second switch.

4. The circuit operator as recited in claim 3, wherein said feet are positioned substantially parallel to each other.

5. The circuit operator as recited in claim 3, wherein said operating means includes a handle, positioned exterior to said housing and coupled to said plate, wherein said plate is moved in said first and second direction by rotating said handle and said plate is moved in said third and fourth direction by moving said handle towards and away from said housing.

6. The circuit operator as recited in claim 5, wherein said handle is coupled to said plate across a shaft.

7. The circuit operator as recited in claim 6, wherein said operating means includes means for converting a rotational movement of said handle to a movement of either the first and second direction of said plate.

8. The circuit operator as recited in claim 6, wherein said operating means includes a first spring means positioned between said housing and said handle for returning said operating means to a normal position.

9. The circuit operator as recited in claim 6, wherein said operating means includes a second spring means positioned between said housing and said plate for returning said operating means to a normal position.

10. The circuit operator as recited in claim 1, wherein said housing includes an openable cover member.

11. The circuit operator as recited in claim 9, wherein said toggle lever includes side surfaces and an upper surface extending between said side surfaces.

12. The circuit operator as recited in claim 3, wherein said operating means includes misalignment means for indicating misalignment of said feet when either of said feet contact said upper surface of said toggle lever.

13. The circuit operator as recited in claim 1, wherein said housing is an explosion-proof enclosure.

14. A circuit operator with a misalignment indicator, comprising:

(a) a housing having an openable cover;

(b) a switch mounted in said housing and having a toggle lever pivotably connected so as to place said toggle switch in its on or off state; and (c) a switch actuator including means for toggling said toggle lever from an exterior of said housing and providing an exterior indication of misalignment of said switch actuator in relation to said toggle, when said openable cover is in a closed position.

15. The circuit operator as recited in claim 14, wherein said toggle lever includes side surfaces and an upper surface extending between said side surfaces and wherein said switch actuator comprises:

a plate positioned in said housing and having a first surface and second surface opposite said first surface, said first surface having two feet extending therefrom; and operating means for moving said plate in a first and second direction to contact said side surfaces to toggle said toggle lever.

16. The circuit operator as recited in claim 15, wherein said toggling means indicates a misalignment when either of said parallel feet is in contact with said upper surface of said toggle lever.

17. The circuit operator as recited in claim 16, wherein said operating means includes a handle positioned external to said housing, said handle, in response to said misalignment, moving a distance away from said housing.

18. The circuit operator as recited in claim 17, wherein said openable cover includes a hole therethrough and said operating means further includes a shaft connected between said plate and said handle, and said shaft having a portion passing through said hole.

19. The circuit operator as recited in claim 14 further comprising a second switch mounted in said housing and having means for initiating tests, said switch actuator further having means for operating said second switch.

20. A circuit breaker operator comprising:

a housing body having an interior volume and a door mounted on the housing body for movement of the door between a closed position where the door encloses the housing interior volume and an opened position where the door provides access to the housing interior volume, and at least one hole passing through one of the housing body and the door, the hole has a center axis;

a shaft passing through the one hole and being received therein for rotational movement and axial reciprocating movement relative to the one hole, the shaft having axially opposite exterior and interior ends;

a plate mounted in the housing interior volume for transverse movement of the plate relative to the one hole center axis and for axial movement of the plate relative to the one hole center axis, the plate being operatively connected to the shaft interior end to cause the plate to move transversely relative to the one hole center axis in response to rotation of the shaft in the one hole, and to cause the plate to move axially relative to the one hole center axis in response to axial movement of the shaft in the one hole; and, the plate has a first foot and a second foot that are spaced transversely from each other adapting the first foot and second foot to accommodate a switch toggle lever therebetween, and the plate has a contact surface to engage a switch push button.

* * * * *